US006769643B2

(12) United States Patent
Bär et al.

(10) Patent No.: US 6,769,643 B2
(45) Date of Patent: Aug. 3, 2004

(54) PROJECTILE TO BE FIRED FROM A BARREL WITH AN OVER-CALIBER CONTROL SURFACE ASSEMBLY

(75) Inventors: Klaus Bär, Lauf (DE); Jürgen Bohl, Eckenhaid (DE); Thomas Leidenberger, Eckental (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 0 days.

(21) Appl. No.: 10/315,681

(22) Filed: Dec. 10, 2002

(65) Prior Publication Data

US 2004/0004156 A1 Jan. 8, 2004

(30) Foreign Application Priority Data

Dec. 18, 2001 (DE) ..... 101 62 136

(51) Int. Cl.[7] ..... F42B 10/14
(52) U.S. Cl. ..... 244/3.28; 244/3.27; 102/384
(58) Field of Search ..... 244/3.29, 3.28, 244/3.27; 102/384, 385

(56) References Cited

U.S. PATENT DOCUMENTS

| | | | | |
|---|---|---|---|---|
| 4,546,940 A | * | 10/1985 | Andersson et al. | 244/3.29 |
| 6,352,218 B1 | * | 3/2002 | Holmqvist et al. | 244/3.29 |
| 6,435,097 B1 | * | 8/2002 | Garner et al. | 102/490 |
| 2003/0146342 A1 | * | 8/2003 | Hellman | 244/3.27 |

FOREIGN PATENT DOCUMENTS

| | | | | |
|---|---|---|---|---|
| DE | 2603756 A1 | * | 4/1977 | F42B/13/16 |
| DE | 2623582 A1 | * | 8/1977 | F42B/13/32 |
| DE | 34 32 614 A1 | | 3/1986 | |
| DE | 35 07 677 A1 | | 9/1986 | |
| DE | 37 21 512 C1 | | 3/1989 | |
| GB | 2077399 A | * | 12/1981 | F42B/13/32 |
| JP | 6101998 A | * | 4/1994 | F42B/10/16 |

* cited by examiner

*Primary Examiner*—Charles T. Jordan
(74) *Attorney, Agent, or Firm*—Scully, Scott Murphy & Presser

(57) ABSTRACT

A projectile (12) to be fired from a rifled barrel (66) is described. At its tail (10) it has control surface vanes (14) which can be pivoted out from a sub-calibre launch position into an over-calibre functional position. To protect the inwardly folded vanes (14) and to protect further ballistic and sensor structures at the tail end of the projectile (12), a securing pot (18) is temporarily fixed to the tail (10) of the projectile (12), the securing pot having a pot peripheral portion (22) and a pot bottom (24). There is a pressure chamber (32) between the tail end face (26) of the projectile (12) and the pot bottom (24) of the securing pot (18). The pot bottom (24) has at least one propellent gas inlet (34) which opens into the pressure chamber (32). When the projectile (12) is fired from the barrel propellent gas flows through the propellent gas inlet (34) into the pressure chamber (32) so that a correspondingly high propellent gas pressure is produced in the pressure chamber (32). After leaving the barrel the pressure difference between the gas pressure in the pressure chamber (32) and the ambient atmosphere then takes effect, whereby the securing pot (18) is separated from the tail (10) of the projectile (12) and the vanes (14) are deployed from the inwardly folded storage position into the outwardly pivoted flight position.

10 Claims, 3 Drawing Sheets

Figure 1:
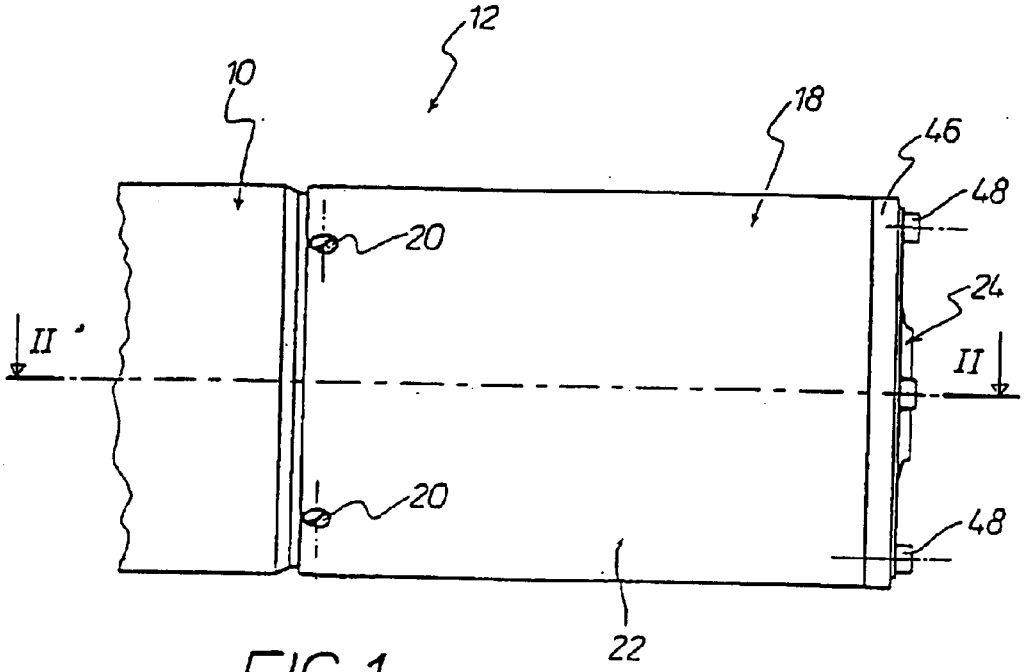

PROJECTILE TO BE FIRED FROM A BARREL WITH AN OVER-CALIBER CONTROL SURFACE ASSEMBLY

BACKGROUND OF THE INVENTION

1. Field of the Invention

The invention concerns a projectile which is to be fired mortar-like from a barrel and which is provided with a control surface assembly comprising control surface vanes which can be pivoted out from a sub-calibre launch position into an over-calibre functional position and which can involve gliding planes or in particular tail control rudders or stabilisation fins.

2. Discussion of the Prior Art

When a projectile with an over-calibre control surface assembly is fired from a barrel the pivotal deployment procedure in respect of the fins which are pivotably mounted for example at the tail of the projectile may be initiated only after leaving the barrel. Unlocking devices which are especially adapted to the respective design configuration involved are known for that purpose. For example DE 34 32 614 A1 describes a projectile with an inflatable body which is folded in when in the rest condition and which, for pivoting open wings of the projectile, is subjected to the action of a highly stressed gas from a pressure container which is specifically carried by the projectile for that purpose, whereby it expands in the radial direction and thus applies a force to the folded-in wings.

DE 35 07 677 A1 discloses a projectile with a control surface assembly in the form of rudder blades which are held mounted pivotably to the tail structure transversely with respect to the longitudinal axis of the projectile, wherein, until being fired from the barrel, the arrangement ensures that the rudder blades are held in a position which is true to the calibre involved and which can be then definedly released upon launch. For that purpose, that arrangement has positively locking arresting means using displaceable securing pins between each rudder blade end face and the peripheral surface of the tail structure. Due to the launch acceleration, each securing pin is displaced in opposite relationship to its holding configuration, whereby the outward pivotal movement of the respective rudder blade into its over-calibre functional position is then enabled.

A similar projectile with an over-calibre control surface assembly whose rudder blades are folded into the projectile structure for storage, transportation and launch and are arrested at their ends in that position until they are released by a securing device, in dependence on launch acceleration, for their outward pivotal movement, is known from DE 37 21 512 C2. In order to embody a compact and functionally efficient securing device which releases all rudder blades at the same time—but not too early —for deployment, the arrangement has a plunger member which engages simultaneously into all rudder blades and which is displaceable axially with respect thereto in the launch direction and which is moved into its release position simultaneously for all rudder blades only upon a reduction in the projectile launch acceleration.

As a consequence of their securing devices which are to be specifically designed for the control surface assembly which is precisely involved in each case, all those known projectiles are of a configuration which is really complicated and expensive in terms of structure and apparatus. To avoid such complication and expenditure it is also known, in the case of projectiles which are fired spin-free and therefore from a smooth barrel, that is to say a barrel which does not have any rifling, for the control surfaces which can be extended at the tail of the projectile to be caused to bear simply against the smooth internal peripheral surface of the barrel, upon being launched from the barrel. That gives rise to problems in particular when the situation does not involve conventionally radially extensible rudder blades (referred to as fins) or wings, but so-called wrap around tail assemblies. In such assemblies shell-shaped control surfaces, in the manner of hollow-cylinder portions, bear in their launch position of being equal to the calibre, against the peripheral surface of the projectile at the outside and against the launch barrel at the inside. Upon the mechanical release thereof as a result of leaving the barrel they pivot outwardly about axes in parallel relationship with the longitudinal axis of the projectile.

If however a projectile is to be spin-stabilised and therefore is to be fired from a barrel provided with rifling, then, when passing through the barrel, due to the extreme acceleration forces which occur in the barrel, damage due to the rifling cutting into the control surfaces sliding therealong cannot be avoided. Then, in free flight, that can have a crucially detrimental effect on the functional efficiency of the projectile, for example because of worsened directional stability.

SUMMARY OF THE INVENTION

In consideration of those aspects, the object of the present invention is to provide a projectile, in particular a projectile which is to be launched in the manner of a spin-stabilised mortar projectile, in which control surfaces which are provided at the tail and which are pivotable about axes parallel or transversely with respect to the longitudinal direction of the projectile are reliably and securely fixed in their calibre-true storage position by means of simple structural measures and, after leaving the barrel, are equally reliably released for deployment into their over-calibre functional position.

In accordance with the invention that object is attained in that a securing pot having a pot peripheral portion and a pot bottom is temporarily fixed to the tail in such a way that the vanes are held in their launch position by the pot peripheral portion, and that a pressure chamber is present between the tail end face of the projectile and the pot bottom of the securing pot, wherein the pot bottom has at least one propellent gas inlet which opens into the pressure chamber.

The projectile which in accordance with the invention is provided with a securing cup or pot for holding control surfaces in the sub-calibre position has the advantage that, in its interior, the securing cup or pot which is equal to the barrel calibre, reliably and securely holds the vanes provided at the tail of the projectile in the inwardly folded storage position. In that way the securing pot also has an optimum protective function in terms of handling requirements in a magazine. That protective function relates not only to the above-mentioned control surfaces but also further ballistic and sensor structures of the projectile, which are disposed at the tail end towards the propellent charge gas chamber in the barrel. A further quite considerable advantage of the projectile which is equipped in accordance with the invention is that the securing pot is reliably jettisoned from the projectile without the use of outside energy after the projectile issues from the barrel, in order thereby to enable deployment of the rudders or the like control surfaces. That is achieved by means of the increased pressure of the propellent gases which, for launching the projectile from the barrel, are produced therein from burning propellent means behind the projectile. That pressure can temporarily amount to the order of magnitude of up to 100 bars and even more. It also passes into the interior of the pot behind the tail of the projectile, through a bottom end opening. After leaving the barrel, that high internal pressure in the pot is suddenly only still subjected to the atmospheric pressure so that the securing pot is rapidly and reliably pushed off the tail of the projectile by the increased internal pressure and thereby liberates the vanes or the like control surface assembly for outward pivotal movement into the over-calibre functional position thereof. That outward pivotal movement is effected under the action of the centrifugal forces of the projectile which is fired with spin and can be still more promoted in known manner by suitable drive systems such as spring elements, pyrotechnic force elements or the like.

In order reliably to guarantee the high pressure in the pressure chamber between the tail of the projectile and the bottom of the securing pot which is fitted thereover during firing of the projectile from the barrel which involves a smooth or preferably a rifled barrel, it is desirable if the pot wall is pressure-tightly sealed in relation to the tail of the projectile. For that purpose, it is possible to provide behind the control surface assembly at least one sealing ring for pressure-tightly sealing off the pot wall at the inside relative to the tail of the projectile. It is helpful for the same purpose if the tail of the projectile also has, in front of the control surface assembly, at least one sealing ring for pressure-tightly sealing it off with respect to the wall of the securing pot. For definedly establishing the pressure chamber between the tail end face and the bottom of the securing pot, the tail end face can be provided with an annular contact face and the securing pot bottom can be provided with an annular support face which bear against each other.

The peripheral portion of the pot can be temporarily fixed to the tail of the projectile by means of shearing pins. The shearing pins afford both a safeguard in terms of transportation and also an in-barrel safeguard. The shearing pins are dimensioned in such a way, that is to say they are formed with desired-rupture locations, that reliable separation of the securing pot from the tail of the projectile is implemented as a consequence of the high pressure in the pressure chamber between the tail end face of the projectile and the bottom of the securing pot, relative to the atmospheric pressure of the outside ambient atmosphere, as occurs after the projectile issues from the barrel. Those pins however cannot be sufficiently loaded to also transmit the twist to the projectile, which is exerted on the wall of the securing pot by the rifling, as the projectile passes through the barrel. Therefore, arranged between the tail of the projectile and the bottom of the securing pot there is also at least one key which prevents relative rotational movement but which comes axially out of engagement when the pot is jettisoned. In order to be able to reliably accommodate that engagement and the high pressure in the pressure chamber during the acceleration of the projectile in the barrel, it is desirable if the bottom of the securing pot involves a large thickness of material, in comparison with the wall of the pot.

The propellent gas inlet into the pot interior is desirably provided with a directional function and is therefore in the form of a nozzle. The nozzle can have a male screwthread portion with which it is screwed into a screwthreaded through hole provided in the bottom of the securing pot. The nozzle can have a central longitudinal hole connected to transverse holes. Such a design configuration ensures that a suitably high pressure is built up during launch of the projectile in the pressure chamber due to the propellent charge gases. The pressure chamber in the pot is therefore virtually pumped up in the barrel with the propellent charge gases, to a suitably high pressure. Under pressure, the large-size tail end face of the projectile and the correspondingly large-size bottom of the securing pot result in a correspondingly high pressure which is directed axially against the bottom of the securing pot and with which the securing pot is separated from the tail of the projectile, with the securing pins being sheared off, after the projectile issues from the barrel, as a result of the above-mentioned pressure difference, so that for example the control surfaces which are pivotably mounted to the tail of the projectile can be pivoted out into their over-calibre position for flight of the projectile.

The projectile according to the invention which is to be fired from a barrel is thus of a very simple structure in terms of ensuring that its tail control surface assembly is in a position which is still sub-calibre when starting, in which respect the securing pot not only has a protective function for the control surface assembly which is still to be held in the inwardly folded condition and for ballistic and sensor structures at the tail end of the projectile, but it also guarantees reliable release of the control surface assembly by virtue of being jettisoned from the tail of the projectile.

BRIEF DESCRIPTION OF THE ACCOMPANYING DRAWINGS

Figure 2:
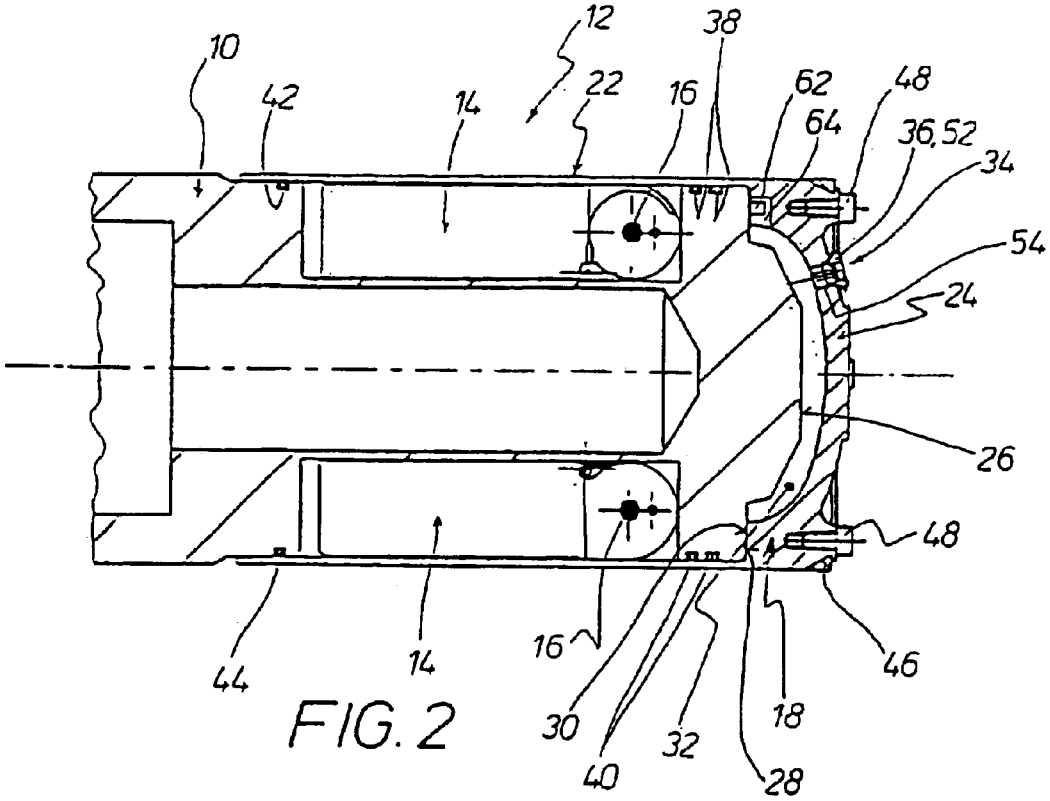
Figure 4:
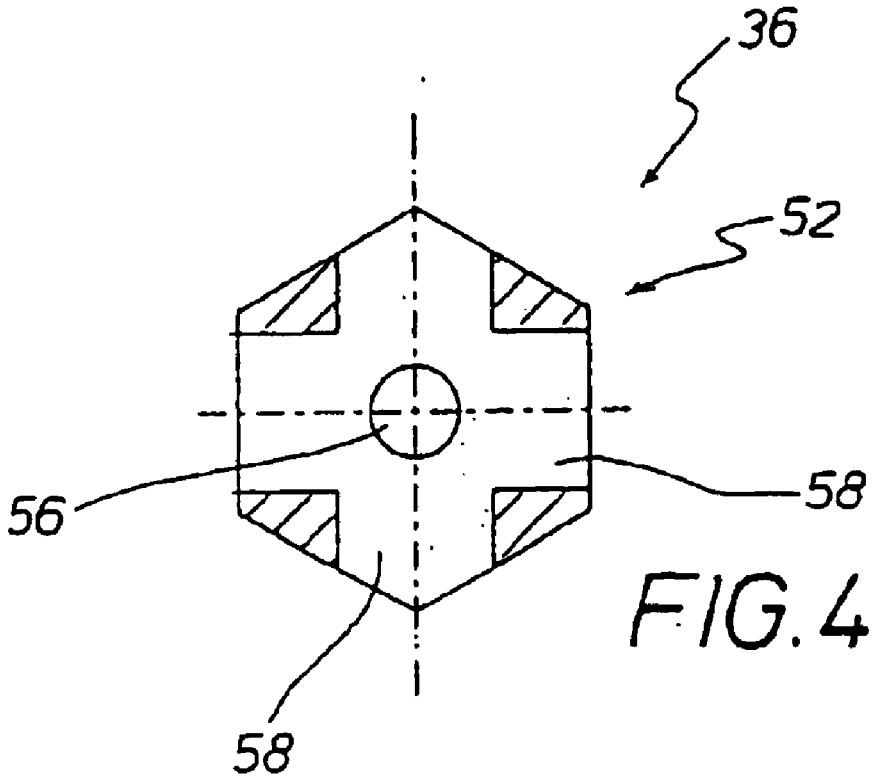
Figure 3:
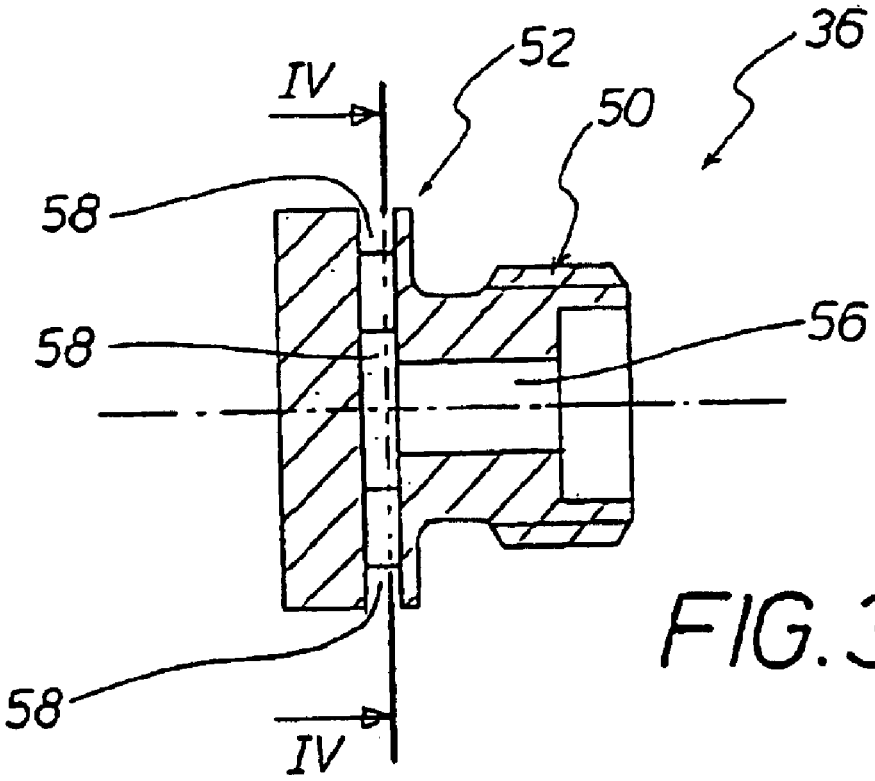
Figure 5:
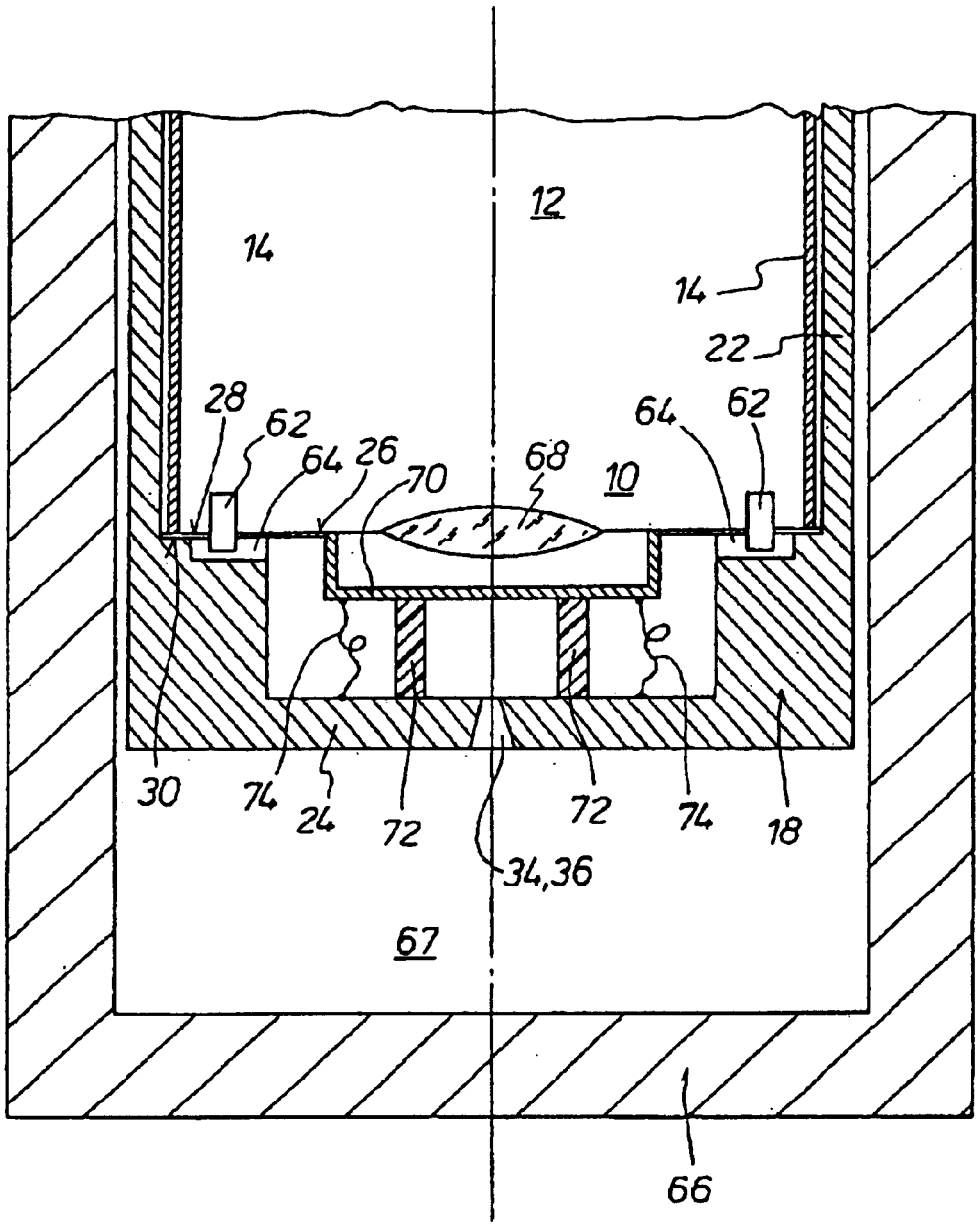

Further details, features and advantages will be apparent from the description hereinafter of an embodiment, illustrated in the drawing, of the projectile according to the invention and substantial details thereof. In the drawing:

FIG. 1 shows a side view of the tail portion of a projectile,

FIG. 2 shows a view in section taken along line II—II in FIG. 1 through the tail portion of the projectile, FIG. 3 shows a longitudinal section through a nozzle of the projectile as shown in FIGS. 1 and 2, FIG. 4 shows a section taken along line IV—IV in FIG. 3, and FIG. 5 shows a supplement to the securing pot with an additional protective function for for example sensor means arranged at the tail end on the projectile.

DETAILED DESCRIPTION OF A PREFERRED EMBODIMENT

FIG. 1 and in particular FIG. 2 show a portion of the tail 10 of a projectile 12 which is to be fired from a barrel and which in particular is a projectile in the manner of a spin-stabilised mortar projectile but with an over-calibre control surface assembly. As can be seen from FIG. 2 for this example, provided at the tail 10 of the projectile 12 are wings or fins 14 which can be deployed from a storage position which is shown in FIG. 2 and which is folded inwardly about axes 16 oriented transversely with respect to the longitudinal axis of the projectile 12, into an outwardly pivoted flight position in which they project from the tail 10. Deployment can occur under the effect of spin and can be assisted for example by means of spring elements (not shown).

A securing cup or pot 18 is temporarily fixed to prevent relative axial displacement thereof on the tail 10 of the projectile 12, by means of shearing pins 20. Keys 62 which are let into the tail 10 arranged distributed around the periphery thereof engage axially into recesses which, to avoid tolerance problems, are in the form of radially oriented grooves 64 in the interior of the securing pot, in a solid annular surface 30 at the edge of the bottom of the securing pot, and which transmit twist applied to the pot 18 in the rifled launch barrel (not shown) to the projectile 12, without relative rotational movement. If, after leaving the barrel, the securing pot 18 is axially ejected from the tail 10, the keys 62 come axially out of engagement with the grooves 64 thereof.

The securing pot 18 has a pot peripheral portion 22 of small wall thickness and a pot bottom 24 of a wall thickness which is large in comparison with the wall thickness of the pot peripheral portion 22. At its rear, the tail 10 of the projectile 12 has a tail end face 26 which is in the form of an annular contact face 28. The pot bottom 24 of the securing pot 18 has an annular support face 30 with which the pot bottom 24 bears against the contact face 28 of the tail 10 of the projectile 12 in order to keep a pressure chamber 32 free between the tail end face 26 and the bottom 24 of the securing pot 18. In the cross-sectional direction, between the tail end face 26 and the bottom 24 of the securing pot, the pressure chamber 32 is of large surface area dimensions which are definedly delimited by the support face 30 of the pot bottom 24. The axial spacing between the tail end face 26 and the pot bottom 24 is relatively small.

The pot bottom 24 of the securing pot 18 has at least one propellent gas inlet 34 with a preferential flow direction into the pot 18, for which reason it is in the form of a nozzle 36 which will be described in greater detail hereinafter with reference to FIGS. 3 and 4. The propellent gas inlet 34 opens into the pressure chamber 32 between the tail end face 26 and the pot bottom 24.

The tail 10 of the projectile 12, in the proximity of the tail end face 26, behind the wings or vanes 14, is provided with peripherally extending grooves 38 in which sealing rings 40 are disposed. The sealing rings 40 serve for pressure-tightly sealing off the peripheral portion 22 of the securing pot 18 relative to the tail 10 of the projectile 12 because propellent charge pressure prevails outside the securing pot 18 in the launch barrel, and that pressure is not to be capable of passing into the structure of the projectile 12. A further peripherally extending groove 42 is provided in front of the vanes or wings 14 in the tail of the projectile 12. Arranged in the peripherally extending groove 42 is a sealing ring 44, by means of which the peripheral portion 22 of the securing pot 18 is additionally sealed off in relation to the tail 10 of the projectile 12. A sealing ring 46 is fixed to the securing pot 18 by means of screws 48.

FIGS. 3 and 4 show a configuration of the nozzle 36 of the propellent gas inlet 34 provided at the pot bottom 24. The nozzle 36 has a male screwthread portion 50 and a hexagonal portion 52. The bottom 24 of the securing pot 18 is provided with a threaded through hole 54 (see FIG. 2) into which the nozzle 36 is screwed with its male screwthread portion 50. The hexagonal portion 52 of a standardised jaw or wrench size serves for screwing the nozzle 36 into place. The nozzle 36 has a central longitudinal hole 56 which is in flow communication with transverse holes 58. The transverse holes 58 are formed in the hexagonal portion 52 in a slot-like configuration in mutually crossing relationship. At the rear they open out of the securing pot 18. The longitudinal hole 56 which communicates with the transverse holes opens into the pressure chamber 32 between the tail end face 26 and the bottom 24 of the securing pot 18.

The mode of operation of the projectile 12 shown in FIGS. 1 and 2 is as follows:

Upon firing of the projectile 12 from a barrel, propellent charge gas flows out of the rearward region of the barrel through the propellent gas inlet 34 in the bottom 24 of the securing pot 18 into the pressure chamber 32 between the pot bottom 24 and the tail end face 26. A correspondingly high gas pressure therefore then prevails in the pressure chamber 32. As soon as the projectile 12 has left the barrel, the pressure difference between the gas pressure in the pressure chamber 32 and the ambient atmospheric pressure takes effect. That pressure produces a corresponding, axially oriented pressure force on the pot bottom 24 so that the shearing pins 20 rupture and the securing pot 18 is pushed axially off the tail 10 of the projectile 12, whereby the wings or vanes 14 are released for deployment from the inwardly folded storage position into the outwardly pivoted flight position.

In the case of a projectile 12 which is fired from a rifled barrel, that is to say a barrel which is formed with rifling therein, the bottom 24 of the securing pot 18 and the tail 10 or the tail end face 26 is formed for example with at least one raised portion (not shown) and a recess adapted thereto respectively, in order to prevent relative rotational movement between the projectile 12 and the securing pot 18.

As a modification of the view shown in FIG. 2, the illustration of the example in FIG. 5 is a broken-away axial longitudinal section in greatly abstracted form and not to scale showing the tail 10 of a projectile 12 in the launch barrel 66 in front of the propellent gas charge chamber 67 thereof, with the tail 10 being embraced by the protective cup or pot 18. This Figure does not show the rifling in the barrel 66 and a guide band which is mounted between the inside wall of the barrel and the outside wall of the securing pot and which slides along the barrel for reducing spin as the projectile passes through the barrel. In this case the projectile 12 is fitted with wings or fins 14 which are bent in a shell-like configuration around the outside peripheral surface of the tail 10. They unroll when the relative increased pressure in the pot interior 32 has resulted in the pot 18 being pushed off rearwardly. In particular however the projectile 12 is now equipped in its tail region 10 with structures which are to be protected from the hot and chemically aggressive propellent charge gases, such as high-frequency or optronic sensors, indicated in the diagrammatic drawing by the lens 68 of an optronic receiver for laser remote control of the projectile trajectory. To protect the lens 68 from the propellent charge gases which accumulate in the interior of the protective pot, a cap 70 is fitted over the lens 68 and pressed gas-tightly against the tail 10 by means of elastic supports 72. The cap 70 is also flexibly tethered to the pot 18 by means of lines 74 or the like. When the pot 18 has then lifted from the tail 10 by the relative increased pressure in the pot interior 32 sufficiently for the gas volume in its interior 32 to expand and to be allowed to escape substantially laterally, the lines 74 are tensioned in order to exert an impulse on the cap 70 and thus also remove it rearwardly from its previous mounted condition.

List of References

10 tail portion (of 12)
12 projectile
14 wings (on 10)
26 axis (for 14)
18 securing pot (on 10)
20 shearing pins (between 10 and 18)
22 pot peripheral portion (of 18)
24 pot bottom (of 18)
26 tail end face (of 10)
28 annular contact face (of 26)
30 annular support face (of 24)
32 pressure chamber (between 24 and 26)
34 propellent gas inlet (into 24)
36 nozzle (of 34)

38 peripherally extending grooves (for 40)
40 sealing ring
42 peripherally extending groove (for 44)
44 sealing ring
46 sealing ring (on 18)
48 screws (for 46)
50 male screwthread portion (of 36)
52 hexagonal portion (of 36)
54 screwthreaded through hole (in 24 for 36)
56 longitudinal hole (in 36)
58 transverse holes (in 52)
62 key
64 groove
66 barrel
67 propellent gas charge chamber
68 lens
70 cap
72 support
74 line

What is claimed is:

1. A projectile (12) which is to be fired from a barrel and which at its tail (10) has control surface vanes (14) which are movable from a sub-calibre launch position into an over-calibre functional position, characterised in that a securing pot (18) having a pot peripheral portion (22) and a pot bottom (24) is temporarily fixed to the tail (10) in such a way that the vanes (14) are held in their launch position by the pot peripheral portion (22) and that a pressure chamber (32) is present between the tail end face (26) of the projectile (12) and the pot bottom (24) of the securing pot (18), wherein the pot bottom (24) has at least one propellent gas inlet (34) which opens into the pressure chamber (32), wherein the pot peripheral portion (22) is pressure-tightly sealed off relative to the tail (10) of the projectile (12), and the tail (10) of the projectile (12) has behind the vanes (14) at least one sealing ring (40) for pressure-tightly sealing off the pot peripheral portion (22) relative to the tail (10) of the projectile (12).

2. A projectile according to claim 1 characterised in that the tail (10) of the projectile (12), in front of the vanes (14), has at least one sealing ring (44) for pressure-tightly sealing off the pot peripheral portion (22) relative to the tail (10) of the projectile (12).

3. A projectile according to claim 1 characterised in that the pot peripheral portion (22) is temporarily fixed to the tail (10) of the projectile (12) by means of shearing pins (20).

4. A projectile according to claim 1 characterised in that the pot bottom (24) is of a large wall thickness in comparison with the pot peripheral portion (22).

5. A projectile according to claim 1 characterised in that the tail end face (26) is formed with an annular contact face (28) and that the pot bottom (24) is formed with an annular support face (30), which faces in a condition of bearing against each other define the pressure chamber (32) between the tail end face (26) and the pot bottom (24).

6. A projectile according to claim 1 characterised in that the propellent gas inlet (34) is in the form of a nozzle (36).

7. A projectile according to claim 6 characterised in that the nozzle (36) has a male screwthread portion (50) with which it is screwed into a screwthreaded through hole (54) provided in the pot bottom (24).

8. A projectile according to claim 6 characterised in that the nozzle (36) has a central longitudinal hole (56) which opens into the pressure chamber (32) between the tail end face (26) and the pot bottom (24) and which is connected to transverse holes (58) on the outside.

9. A projectile according to claim 1 characterised in that arranged in the interior (32) of the pot is a cap (70) for protecting structures in the tail region (10).

10. A projectile according to claim 1 characterised in that an axially separable non-rotational connection (62–64) is provided between the tail (10) and the pot (18).

* * * * *